US006314777B1

(12) United States Patent
Allen

(10) Patent No.: US 6,314,777 B1
(45) Date of Patent: Nov. 13, 2001

(54) REVOLVER CYLINDER MAGNETIC GUNLOCK

(75) Inventor: Noel Lewis Allen, Burnsville, MN (US)

(73) Assignee: Gun Lock Corp., Lakeville, MN (US)

( * ) Notice: Subject to any disclaimer, the term of this patent is extended or adjusted under 35 U.S.C. 154(b) by 0 days.

(21) Appl. No.: 09/239,940

(22) Filed: Jan. 29, 1999

(51) Int. Cl.[7] ..... F41A 17/44

(52) U.S. Cl. ..... 72/70.11; 42/59; 42/66; 42/67; 42/84; 42/96; 42/99

(58) Field of Search ..... 42/1.13, 66.67, 42/59, 96, 70.01, 70.04, 70.05, 70.06, 99, 84, 70.11

(56) References Cited

U.S. PATENT DOCUMENTS

| | | | | |
|---|---|---|---|---|
| 2,479,107 | * | 8/1949 | Garretson | 42/70.11 |
| 2,480,593 | * | 8/1949 | Moen et al. | 42/1.13 |
| 2,512,252 | * | 6/1950 | Lehn | 42/1.13 |
| 3,027,674 | * | 4/1962 | Mahan | 42/66 |
| 3,360,880 | * | 1/1968 | Finnegan | 42/70.11 |
| 4,048,741 | * | 9/1977 | Chiodo et al. | 42/1 |
| 4,092,794 | * | 6/1978 | Moren | 42/1 |
| 4,110,928 | | 9/1978 | Smith | 42/66 |
| 4,213,263 | | 7/1980 | Brouthers | 42/59 |
| 4,398,366 | * | 8/1983 | Wernicki | 42/1 LP |
| 4,461,108 | * | 7/1984 | Von Muller | 42/1 LP |
| 4,479,320 | * | 10/1984 | Fix | 42/1 |
| 4,761,906 | * | 8/1988 | Guevara | 42/70.11 |
| 4,802,298 | * | 2/1989 | Baugus | 42/70.11 |
| 5,052,142 | * | 10/1991 | Mikus | 42/70.11 |
| 5,179,234 | * | 1/1993 | Cvetanovich | 42/70.11 |
| 5,241,770 | | 9/1993 | Lambert | 42/70.11 |
| 5,357,704 | * | 10/1994 | Benkovic | 42/70.11 |
| 5,412,959 | | 5/1995 | Bentley | 70/30 |
| 5,433,028 | * | 7/1995 | Novak et al. | 42/70.06 |
| 5,488,794 | * | 2/1996 | Arrequin | 42/70.11 |
| 5,651,206 | * | 7/1997 | Matarazzo | 42/70.08 |
| 5,737,864 | * | 4/1998 | Otto | 42/70.11 |
| 5,743,039 | | 4/1998 | Garrett | 42/70.11 |
| 5,758,524 | * | 6/1998 | Yu | 70/276 |
| 6,070,512 | * | 6/2000 | Rohrbaugh | 89/147 |
| 6,154,996 | * | 12/2000 | Andreassen | 42/70.11 |

FOREIGN PATENT DOCUMENTS

| | | | | |
|---|---|---|---|---|
| 2234047-A | * | 1/1991 | (GB) | F41A/17/44 |
| WO-88-09 | * | 12/1988 | (WO) | F41C/17/08 |

OTHER PUBLICATIONS

Popular Mechanics magazine, dated Sep. 1998, p. 88, entitled: Outdoors—Loaded and Locked by Ron Spomer.

* cited by examiner

*Primary Examiner*—Michael J. Carone
*Assistant Examiner*—John Richardson
(74) *Attorney, Agent, or Firm*—McCormick, Paulding & Huber LLP

(57) ABSTRACT

A revolver-lock device including a positive means, for locking of the bullet cylinder, a lock-housing for containing lock mechanism components, an extension rod, an inner permanent magnet, an extension spring, a multiple number of balls or similar members, a housing sealing disc, an external magnet key with slot, means for preventing retraction of the locking expansion balls from the cylinder walls, for preventing insertion of bullets into the cylinder holes, and for preventing the cylinder from rotating, and thus operation of the trigger, hammer and firing pin, means for restricting the bullet firing caps to be off-line with the firing pin, means for preventing the revolver cylinder from being opened for loading, a method for high volume, low cost production due to simplicity of design, a quick activating/deactivating means for fast use of the revolver, a compact size and shape which allows easy casing of the revolver, a parts interchanging feature for similar revolvers of the same caliber and for different caliber revolvers. An overall design concept which is used to produce a family of similar revolver-locks for a majority of revolver with minimal redesign, for use in home, military, federal, state and city agencies.

16 Claims, 4 Drawing Sheets

REVOLVER CYLINDER MAGNETIC GUNLOCK

FIELD OF THE INVENTION

The present invention relates in general to a gunlock and more particularly to a magnetically operated revolver lock, which causes interference inside of one of the bullet cylinder chambers by radial captured balls, such that the cylinder cannot rotate as to align a round with the firing pin, that any munitions round will be off-line with the firing pin, that the cylinder cannot open away from the revolver to load the revolver and the revolver hammer cannot extend back sufficiently to cause activation of the firing pin. Deactivation of the lock is accomplished by insertion of a magnetic key into a hole in the rear of the lock-housing, causing the balls to retract Into the lock-housing ball captivating hole, thus allowing the lock to be withdrawn from the revolver.

BACKGROUND OF THE INVENTION

The safety of commercially available and existing or used firearms has become a national issue, with recent legislation passed, requiring a dealer to offer a locking means for the firearms at the time of purchase. The concern for loaded and unlocked firearms within the household may soon result in a mandatory law that requires all firearms, new and used, have locking devices. Few gunlocks are designed exclusively for revolvers. Most gunlocks available are designed to be used on all types of firearms with the result that some features are not optimized for revolver application.

Conventionally, and in the past, many revolver gunlocks lock the firearm trigger by interlocking two separate pieces together around the trigger area. Additionally, there are revolver gunlocks in which a cable or chain is inserted into the barrel and out the rear breach of the firearm and ultimately secured on either end, thereby making the firearm inoperative. There is also a plug device that fits inside of a revolver cylinder hole to prevent cylinder rotation, but does not function as a locking device but only as a plug device.

Examples of representative patented inventions are as follows:

U.S. Pat. No. 4,110,928 issued Sep. 5, 1978 to Smith for Safety *Device for Preventing Unauthorized Actuation of Touch-Actuated Mechanism* describes a magnetically operated trigger lock in which a pivotally mounted magnetically responsive bar positioned on the inside of the handle of the firearm is displaced allowing for trigger movement when the user wears a magnetic ring to activate the device. The '928 device requires a modification to the firearm in order to install the magnetically responsive bar inside the handle of the firearm.

U.S. Pat. No. 5,743,039 issued Apr. 28, 1998 to Garrett for *Combination Locking Device for Firearms* relates to a combination locking device either for engaging or disengaging existing safety devices on firearms, or as an independent safety device to block the firing mechanism of the firearm. The '039 device is a mechanical spring-loaded assembly that, like the '928 device above, requires a modification of the firearm.

U.S. Pat. No. 5,241,770 issued Sep. 7, 1993 to Lambert for *Gun Locking Apparatus* depicts a locking device for revolvers in which an outer tube having a plurality of collet spring fingers at one end receives a central mandrel in complementary coaxial relationship with it, wherein the outer tube with the central mandral inserted effects a spreading of the collet fingers to permit engagement with a rear terminal end of an associated revolver cylinder or barrel of a long arm, such as a rifle. The collet fingers include annular flanges received with the rear face of the cylinder or chamber for locking the device within the revolver structure. Coaxially aligned bores of the outer tube and the central mandral when aligned permit positioning of a padlock therethrough to lock the device in position.

U.S. Pat. No. 4,213,263 issued Jul. 22, 1980 to Brouthers for *Firearm Trigger Guard Assembly* features a trigger guard assembly removably secured to the frame of the firearm by three support points. The first support point is a lug and socket means at the front of the trigger guard frame. The second support point is provided by a spring-biased plunger at the rear of the trigger guard assembly having a wedged end coacting with a slot in the frame. The third support point comprises a pin means extending through ears of the trigger guard frame and the revolver frame and providing a pivot pin for the hammer.

U.S. Pat. No. 5,357,704 issued Oct. 25, 1994 to Benkovic for *Firearm Lock* is directed to a gunlock comprising a hardened steel rod threaded at each end, the threaded ends respectively engaging a cartridge shaped plug and rotatable tumbler lock. The lock is fixed within a sleeve body adapted to fit snugly around a barrel end of a firearm to be locked. The cartridge plug fits snugly within the firing chamber of the firearm in the same manner as a cartridge adapted to be fired within the gun. The rod inserted down the bore of the barrel is threadedly engaged with the cartridge plug by rotating a mating key engaged in the lock. Removal of the key secures the gunlock within the firearm.

U.S. Pat. No. 5,412,959 issued May 9, 1995 to Bentley for *Gun Lock Assembly* is directed to a gunlock comprised of a two major components, an elongated rod member and a predetermined length of flexible cable whose opposite ends can be secured together with a lock. The elongated rod member has a shank portion of sufficient length to extend into the breech of a gun. The head portion has an aperture through which the cable is threaded. The cable is also threaded through a trigger guard and locked. The flexible cable has a predetermined length such that the rod member cannot be removed from the gun barrel without unlocking the lock.

The above patent inventions all provide a solution to the locking of firearms and usually to handguns. All have limitations, however, in that they require a modification to the firearm to install, or they are expensive to purchase or they have a key that does not permit rapid unlocking in tactical or unlit situations. Most are of a size that makes casing or holstering difficult These limitations may deter the firearm owner from locking the firearm, resulting in a situation where firearms are deliberately left unlocked loaded for security reasons. No revolver gunlock is known to exist in which the design is specifically directed to a revolver such that the cylinder of the revolver is positively locked and secured by a lock-housing with multiple radial protruding balls, cam rollers or other shaped particles, or by means of an internal ball/cam roller expanding/extracting plunger rod, restoring spring and inner attached permanent magnet, and to have the capability of being quickly or instantaneously magnetically activated and deactivated. Such a gun lock would be inexpensive and would allow the firearm to have munitions rounds in the remaining cylinder chambers for rapid loading in the event of an emergency, and be compact for ease of casing or holstering.

SUMMARY OF THE INVENTION

An object of the invention is to provide a device that locks a revolver bullet cylinder chamber such as by inserting a tubular section portion of a lock-housing with a plurality of radial expanding balls, cam rollers, or similar components staked in a same plurality of captive holes or openings along the tubular section, into the revolver cylinder from the front, towards the rear, and in which the balls are positively captured between the inner rear and forward walls of the cylinder bullet hole and the housing tubular section, at the shoulder junction of the two adjoining walls such that the locking device cannot be conventionally defeated without the disengagement of the interfering balls by use of a magnetic key, mechanical key, or other locking/unlocking/key mechanism.

It is also an object of the present invention to provide such a revolver-locking device that positively secures a cylinder bullet hole of a revolver so as to not allow the necessary rotation of the cylinder to fully cock the hammer of the revolver, thereby rendering the firearm safe from discharging a round.

It is also an object of the present invention to provide such a revolver-locking device that secures a cylinder of a revolver into such a rotated position so as to not allow the bullet cap to be in line with the barrel chamber, thereby rendering the firearm safe from discharging a round.

It is also an object of the present invention to provide such a device that can be unlocked in a very rapid time period, such as by magnetic activation/deactivation, when properly performed, and thus allows quick unlocking of a revolver firearm, for use in emergencies, with the option of having munitions rounds to be held within in the remaining cylinder chamber holes of the revolver for such purpose.

It is also an object of the present invention to provide such a revolver-locking device that secures a cylinder of a revolver into such a rotated position so as to not allow the bullet firing cap to be in line with the barrel chamber, thereby rendering the firearm safe from discharging a round, and consequently safely allows munitions rounds to be held within in the remaining cylinder holes of the revolver.

It is also an object of the present invention to provide such a device that provides a faster lock/unlock operation than most other conventional gunlocks, allowing rapid access to the firearm for use, achieved by designing the system to quickly magnetically lock or release through insertion of a magnetic key into the key plenum in the rear of the lock-housing, attracting another magnet inside of the housing attached to the ball plunger activating rod, upon which the locking device and attached key assembly may be immediately pulled out forward, towards the barrel end, from the cylinder bullet hole of the revolver, and which may remain attached to the key on a chain for reuse, later.

It is also an object of the present invention to provide such a device that can be unlocked in a faster time period than most other conventional locks, such as by magnetic activation/deactivation, when properly performed, with out modification or alteration of the revolver components or assembly.

It is also an object of the present invention to provide such a device that can be unlocked in a faster time period than most other conventional locks, such as by close proximity magnetic activation/deactivation, when properly performed, and consequently reasonably allows unlocking of the lock in a dark lighted environment.

It is also an object of the present invention to provide such a revolver-locking device that positively secures a cylinder bullet hole of a revolver type of firearm on the side opposite that in which the cylinder swings opens from the body of the revolver during loading operation, to not allow the revolver cylinder to be loaded with bullets, thereby rendering the firearm safe while presenting the revolver.

It is also an object of the present invention to provide such a device that maintains the revolver-lock profile close to the general outline or surface area projection of a revolver, so as to allow easy casing of the revolver.

The foregoing objects can be accomplished by providing a device having a lock-housing, having an actuating plunger rod with a permanent magnet on one end and having a tapered or necked down area on the opposite, forward end, having a restoring extension spring attached to the opposite rear region of the rod ahead of the magnet, and also to an inner bore shoulder in the lock-housing, having a plurality of balls or rods inserted and staked into radial holes in the forward cylindrical portion of the lock-housing, having a sealing disc inserted into the rear of the lock-housing, providing a stop for the inner magnet when activated by the external magnet key assembly, and having a magnetic type of activating/deactivating key which operates the lock assembly

DETAILED DESCRIPTION OF THE PREFERRED EMBODIMENTS

Figure 1:
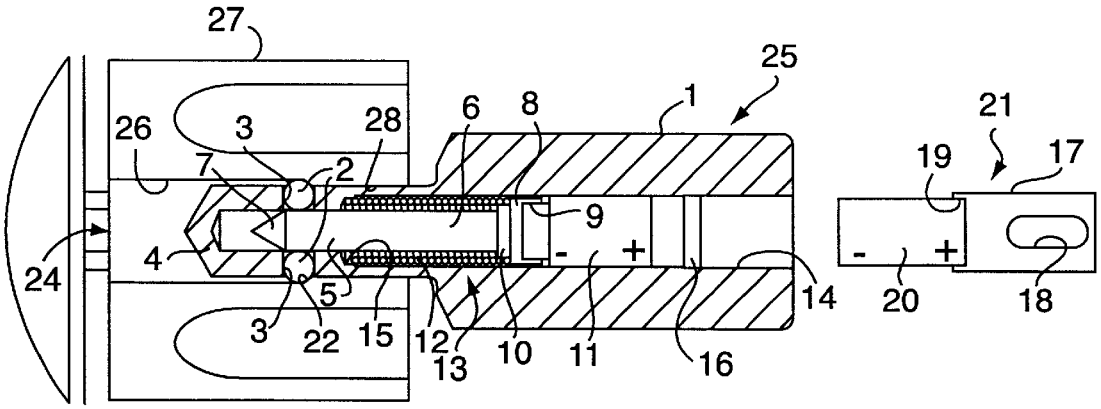
FIG. 1 is a cross section of the revolver cylinder gunlock device, in locked position, in accordance with the present invention.
Figure 2:
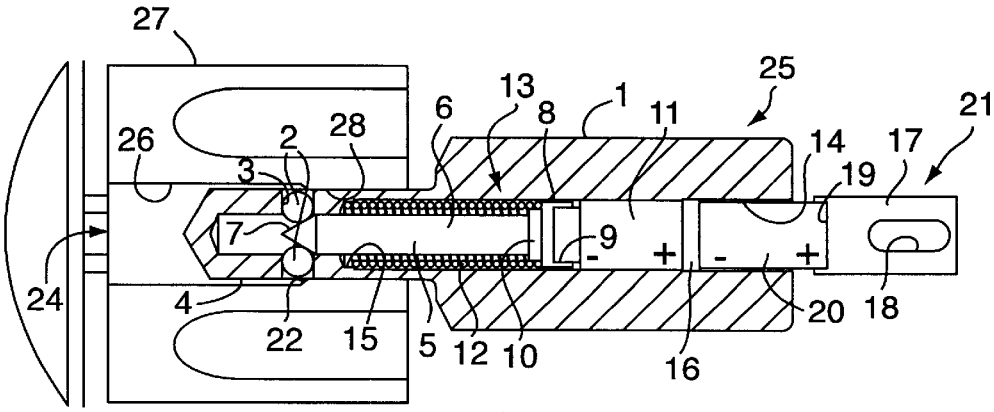
FIG. 2 is a cross section of the revolver cylinder gunlock device in unlocked position in accordance with the present invention.

As shown in FIGS. 1 and 2, the preferred cylinder gunlock device in accordance with the present invention includes a lock-housing 1, which preferably is of a strong, hard non-magnetic material, and serves to confine the device primary mechanism pieces. The lock-housing contains a plurality of balls 2, which are staked into captive holes 3 located at an appropriate distance along the lock-housing front tubular section 4, and which are allowed to float radial between the staked areas and an internal ball activation rod 5. The ball activation rod 5 consists of a long rod cylindrical section 6, a tapered or necked down section 7 on the front end of the rod cylindrical section 6, a rearward rod boss 8, opposite the rod tapered end 7, with a rod magnet hole 9 extending inward into the rod boss 8, and a rod spring engagement shoulder 10, just ahead of the rod boss 8 towards the tapered end 7. Attached to the rear of the rod 5, and preferably pressed into the boss magnet hole 9, is a housing magnet 11. Also, an extension spring 12 is fed over the cylindrical section 6 onto the rod spring engagement shoulder 10, and preferably pressed onto the rod spring engagement shoulder 10, resulting in a sub assembly of ball activation rod 5, housing magnet 11, and extension spring 12, hereby denoted as the activation rod assembly 13.

The assembly of activation rod 5, housing magnet 11 (which in other applications may be a strongly ferrous material), and extension sprin 12, are directed into the housing 1 from the rear, through a housing hole 14, until the extension spring 12 is attached, and preferably is press-fitted, into the housing spring engagement bore 15 portion of the housing hole 14, located slightly behind the ball holes 3. The resulting assembly thereby confines the rod 5, spring 12 and housing magnet 11, inside of the housing hole 14 within the lock-housing 1. A seal disc 16 is pressed into the rear of the housing 1 to contain the components inside, after assembly of the components within the housing 1, and preferably is of a high hardness stainless alloy.

Figure 4:
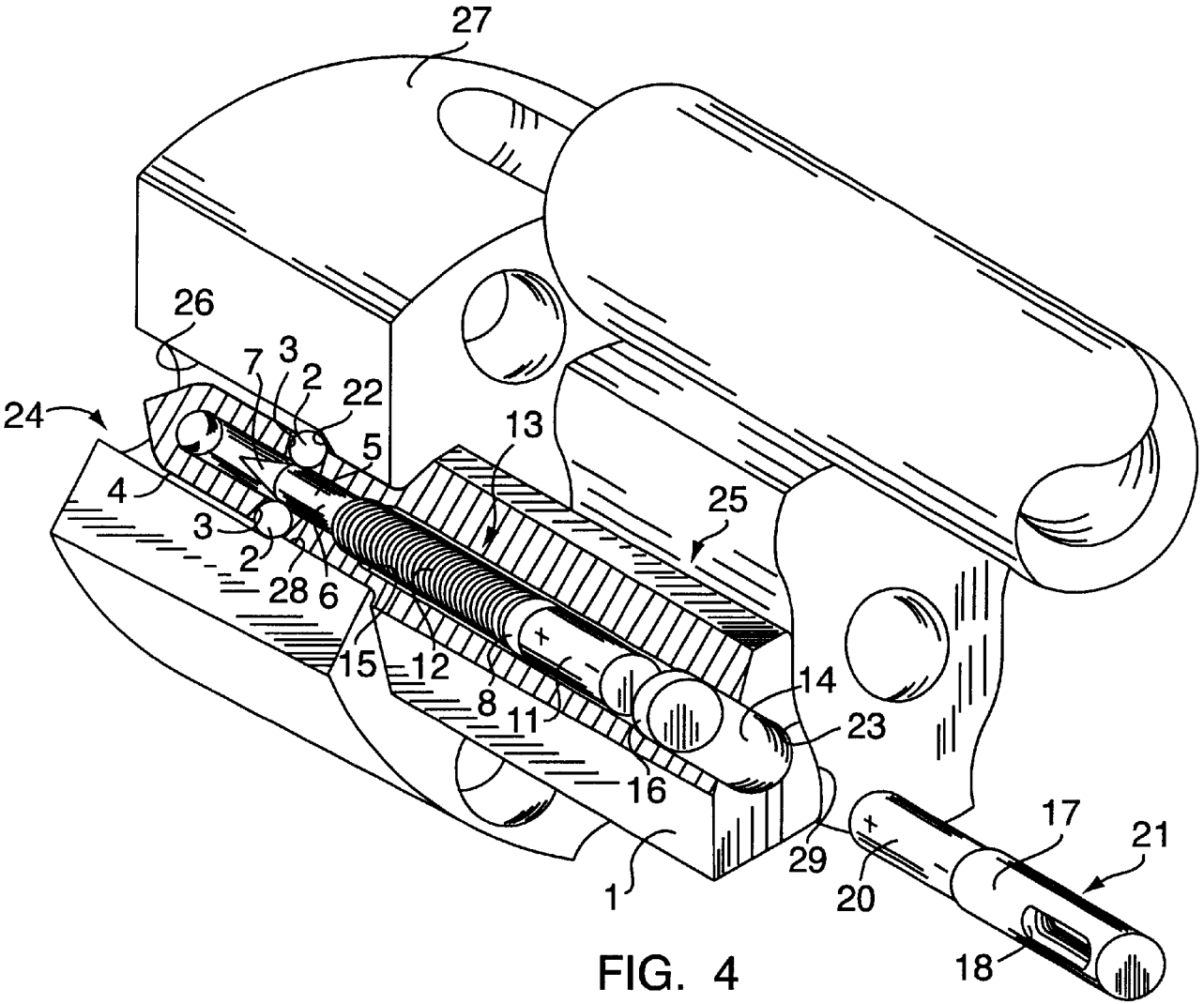
FIG. 4 is an isometric perspective view of the revolver cylinder lock in the locked position, and a fragmentary of a typical revolver cylinder and surrounding components.
Figure 5:
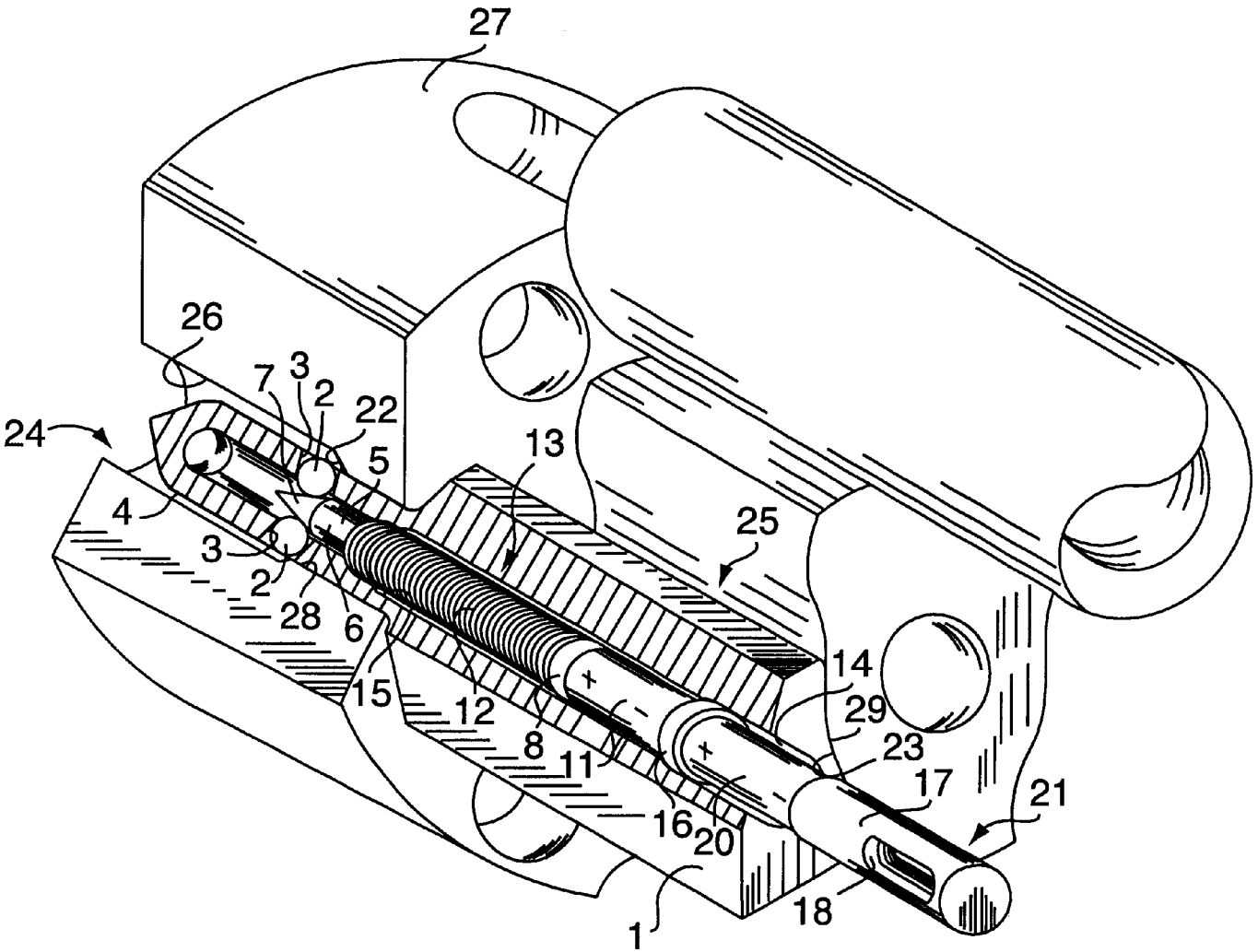
FIG. 5 is an isometric perspective view of the revolver cylinder lock in the unlocked position, and a fragmentary of a typical revolver cylinder and surrounding components.

The resulting subassembly is denoted as the revolver lock-housing assembly 25, as shown in FIGS. 1 and 4.

Additionally, a separate key housing 17 consists of a cylindrical body with a necklace or key chain slot 18 on the rear end, and a key magnet insertion hole 19 on the opposite end. A key magnet 20, is inserted into the magnet insertion hole 19, and preferably press fitted into the hole 19.

The key magnet 20 is inserted into the key housing 17 such that the key magnet 20 polarity is oriented to attract the housing magnet 11 within the lock-housing 1, when the key magnet 20 activating end is inserted into the rear of the housing hole 14 near the seal disc 16. The resulting subassembly consisting of the key housing 17 and key magnet 20 are denoted as the key assembly 21.

Preferably, all of the components, excluding the magnets and key chain or necklace, are of a nonmagnetic hard stainless steel, except that the balls 2 and the spring 12 may preferably be of a slightly magnetic hard stainless material.

In use, the key magnet portion of the key assembly is inserted into the rear of the lock-housing hole until it activates the housing magnet and corresponding activating rod assembly inside of the lock-housing.

This causes the two magnets to magnetically stick against opposite sides of the seal disc 16, due to the magnetic attraction force between the two magnets. This causes the activation plunger rod to move rearward, extending the extension spring until the tapered end is over the region containing the balls, thus providing a looseness of the balls in the captivating holes. The housing tubular section of the housing assembly is then inserted fully into one of the revolver empty cylinder chamber holes, such that the balls are located past the revolver cylinder inner bullet chamber constraining shoulder 22, and preferably on the side opposite that which the cylinder opens for loading, which is usually the left side, when the revolver is viewed from the barrel end, and which abuts against the revolver outer barrel area such that the cylinder cannot rotate as to align a round with the firing pin, and also prevents the revolver cylinder to be opened from the revolver body for access to the bullets, or for loading while locked, and also prevents the revolver hammer from being activated.

The key assembly containing the key magnet is next pulled away from the rear of the lock-housing, causing the extension spring to retract, pulling the activating rod forward until the extension spring fully retreats, leaving the spring with only its tension. The rod cylindrical section now seats fully around the captivating holes, forcing the balls radial outward along the captivating holes, due to the cam effect of the tapered end of the activating plunger rod when moving forward. The size of the rod cylindrical section and two ball diameters are the distance that the balls project outward and leaves a small amount of required spatial gap or slop between the balls and the larger diameter of the revolver bullet holes, subsequentially trapping the exposed portions of the plurality of balls between the larger bullet hole chamber and the rod cylindrical section. The typical interference is about .020 inches per balll for most revolver types, and the typical force to shear the projected plurality of ball 2 proportions along the smaller bullet charmer 28 wall when pulling the housing forward is approximately 600 to 1800 lbs., depending on the caliber of revolver and corresponding ball size. To remove the housing assembly, the key magnet portion of the key assembly is inserted into the rear of the housing hole until the two magnets attract towards one another, and stick on either side of the seal disc (or conversely, repel one another, in a reverse design). This causes the balls to once again become loose in the captivating holes, and which will retract into the captivating holes upon pulling of the housing forward out of the revolver smaller cylinder chamber 28, due to the balls being struck by the walls of the smaller bullet cylinder chamber, thus unlocking the revolver cylinder from the revolver-lock assembly. The combined revolver-lock assembly 25 and key assembly 21 are now magnetically locked to one another, and may be worn ok a key chain or necklace (not shown) which may be attached to the key housing by means of the key slot, while using the revolver.

Figure 6:
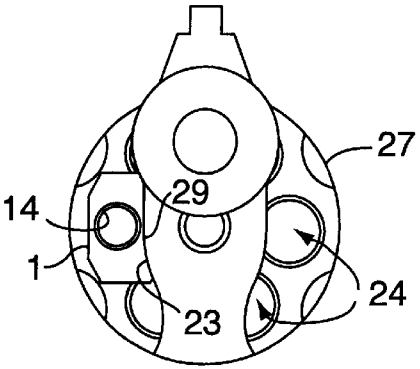
FIG. 6 is a rear elevation of the revolver cylinder gunlock device, in locked position, in accordance with the present invention.
Figure 3:
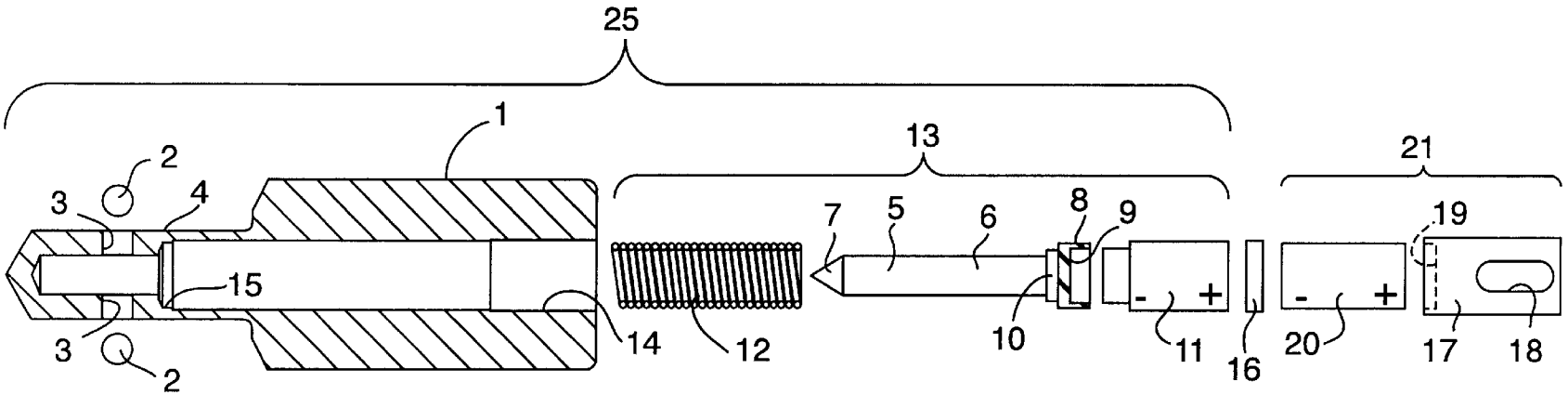
FIG. 3 is an exploded cross section of the cylinder gunlock of the component parts of such device.

All conventional revolver cylinders 27 have a concentric shoulder 22 in each cylinder chamber 24 to house both a bullet casing and a bullet round with close fit up between the plurality of balls and the cylinder chamber 24 profile, where the balls can be positively captured when forced outward to occupy the excess space provided by the two different diameters in the front small and rear, large cartridge chamber 28 and 26 location walls. This design directly takes advantage of the cylinder shoulder protrusion in locking of the plurality of expandable balls within the revolver cylinder 27. Consequently, the revolver gunlock serves to stop a revolver cylinder 27 from rotating by use of the cylinder chamber wall shoulder 22, thus rendering the revolver inoperative. The lock-housing 1 preferably has the side which lies against the revolver main housing machined such that the tubular section has a flat zone of appropriate depth to allow for the smal distance between the revolver main housing and the revolver cylinder on some revolvers, to make the housing fi as many revolvers as possible without special modification for each. Additionally, as depicted in FIG. 6 in the inward side 29 of the lock-housing, as explained above, preferably has a general profile shape that closely corresponds with that of the revolver side profile 23 or geometry in the region that the lock-housing will locate at, so as to further limit any rotational movement of the lock-housing and consequently, the revolver cylinder 27.

The design shape of the key magnet is shown to be cylindrical, however, there may be many various shapes for the key magnet and the housing rear hole portion, to allow many key style designs, rather than only one or two.

The foregoing description of the preferred embodiment of the invention has been presented for the purposes of illustration and description. It is not intended to be exhaustive or limit the invention to the precise form disclosed. Many modifications and variations are possible in light of the above teaching. It is intended that the scope of the invention be limited not by this detailed description, but rather by the claims appended hereto.

What is claimed is:

1. A locking device for locking a revolver having a cylinder with a cylinder chamber, the cylinder chamber having a bullet cartridge portion, a relatively smaller diameter bullet round portion and a chamber constraining shoulder therebetween, the locking device comprising:

a lock housing including a front tubular section and a rear section, the front tubular section being sized to fit through the bullet round portion and extend past the constraining shoulder of the cylinder chamber, the front tubular section including a housing hole extending axially therein and a captive hole extending radially therethrough to the housing hole, the rear section attached to a distal end of the front tubular section and having a relatively larger outer periphery than the front tubular section;

a camming member disposed within the captive hole; and an activation rod movable within the housing hole between a locked position and an unlocked position, the activation rod having a major periphery and a smaller minor periphery;

wherein, when the activation rod is in the unlocked position, the camming member engages the minor periphery and is disengaged from the constraining shoulder, and wherein, when the activation rod is in the locked position, the camming member is captured between the major periphery of the activation rod and the constraining shoulder of the cylinder chamber, and the rear section is engaged against the cylinder.

2. The locking device of claim 1 wherein the captive hole further comprises a plurality of captive holes and the camming member further comprises a corresponding plurality of camming members.

3. The locking device of claim 1 wherein the camming member further comprises a ball.

4. The locking device of claim 1 further comprising a spring having a first end portion attached to the activation rod and a second end portion attached to the lock housing, wherein the spring moves the activation rod from the unlocked position to the locked position to lock the revolver.

5. The locking device of claim 4 further comprising:

a portion of the housing hole extending through the rear section of the lock housing to define a key hole portion of the housing hole;

a housing magnet attached to a distal end of the activation rod within the rear section; and a magnetic key sized to be inserted into the key hole portion;

wherein, when the magnetic key is inserted into the keyhole portion of the housing hole, the housing magnet is attracted toward the magnetic key to move the activation rod from the locked position to the unlocked position.

6. The locking device of claim 1 wherein the outer periphery of the rear section of the locking device is within the outer periphery of the revolver when the locking device locks the revolver.

7. The locking device of claim 1 wherein the activation rod further includes a tapered surface extending between the minor periphery and the major periphery.

8. The locking device of claim 1 wherein the minor periphery is a minor diameter, and the major periphery is a major diameter.

9. A revolver comprising:

a cylinder with a cylinder chamber, the cylinder chamber having a bullet cartridge portion, a relatively smaller diameter bullet round portion and a chamber constraining shoulder therebetween; and a locking device for locking the revolver, the locking device including, a lock housing including a front tubular section and a rear section, the front tubular section being sized to fit through the bullet round portion and extend past the constraining shoulder of the cylinder chamber, the front tubular section including a housing hole extending axially therein and a captive hole extending radially therethrough to the housing hole, the rear section attached to a distal end of the front tubular section and having a relatively larger outer periphery than the front tubular section;

a camming member disposed within the captive hole; and an activation rod movable within the housing hole between a locked position and an unlocked position, the activation rod having a major periphery and a smaller minor periphery;

wherein, when the activation rod is in the unlocked position, the camming member engages the minor periphery and is disengaged from the constraining shoulder, and wherein, when the activation rod is in the locked position, the camming member is captured between the major periphery of the activation rod and the constraining shoulder of the cylinder chamber, and the rear section is engaged against the cylinder.

10. The revolver of claim 9 wherein the captive hole further comprises a plurality of captive holes and the camming member further comprises a corresponding plurality of camming members.

11. The revolver of claim 9 wherein the camming member further comprises a ball.

12. The revolver of claim 9 further comprising a spring having a first end portion attached to the activation rod and a second end portion attached to the lock housing, wherein the spring moves the activation rod from the unlocked position to the locked position to lock the revolver.

13. The revolver of claim 12 further comprising:

a portion of the housing hole extending through the rear section of the lock housing to define a key hole portion of the housing hole;

a housing magnet attached to a distal end of the activation rod within the rear section; and a magnetic key sized to be inserted into the key hole portion;

wherein, when the magnetic key is inserted into the keyhole portion of the housing hole, the housing magnetic is attracted toward the magnetic key to move the activation rod from the locked position to the unlocked position.

14. The locking device of claim 9 wherein the outer periphery of the rear section of the locking device is within the outer periphery of the revolver when the locking device locks the revolver.

15. The locking device of claim 9 wherein the activation rod further includes a tapered surface extending between the minor periphery and the major periphery.

16. The locking device of claim 9 wherein the minor periphery is a minor diameter, and the major periphery is a major diameter.

* * * * *